US007198267B2

(12) United States Patent
Förch et al.

(10) Patent No.: US 7,198,267 B2
(45) Date of Patent: Apr. 3, 2007

(54) SHEET PROCESSING MACHINE WITH A SHEET DECURLER

(75) Inventors: Peter Förch, Neustadt (DE); Sven Kerpe, Eggenstein-Leopoldshafen (DE); Markus Möhringer, Weinheim (DE); Paul Nicola, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 374 days.

(21) Appl. No.: 10/782,323

(22) Filed: Feb. 19, 2004

(65) Prior Publication Data

US 2004/0188932 A1 Sep. 30, 2004

(30) Foreign Application Priority Data

Mar. 27, 2003 (DE) ..... 103 13 718

(51) Int. Cl.
*B65H 5/12* (2006.01)

(52) U.S. Cl. ..... 271/204; 271/277; 271/275; 271/276

(58) Field of Classification Search ..... 271/204, 271/277, 270, 275
See application file for complete search history.

(56) References Cited

U.S. PATENT DOCUMENTS 3,413,732 A 12/1968 Koch et al.
4,799,664 A 1/1989 Burger
5,431,386 A 7/1995 Blaser
6,578,846 B2 * 6/2003 Maul et al. ..... 271/277
6,663,550 B2 * 12/2003 Frankenberger et al. .... 493/256
2002/0135123 A1 9/2002 Maul et al.

FOREIGN PATENT DOCUMENTS

| | | |
|---|---|---|
| DE | 627 851 | 3/1936 |
| DE | 1 260 482 | 2/1968 |
| DE | 36 05 534 A1 | 8/1987 |
| DE | 42 18 421 A1 | 12/1993 |
| DE | 44 27 897 C1 | 9/1995 |
| DE | 100 14 417 A1 | 9/2001 |

* cited by examiner

*Primary Examiner*—Patrick Mackey
*Assistant Examiner*—Kaitlin Joerger
(74) *Attorney, Agent, or Firm*—Laurence A. Greenberg; Werner H. Stemer; Ralph E. Locher

(57) ABSTRACT

A sheet-processing machine, such as a rotary press, has normally closed grippers that circulate during operation. The grippers transport the sheets along a conveying section and guide the sheets at their leading and trailing edges. The conveying section is assigned a sheet decurler and a sheet guide device that follows the latter in the conveying direction. The conveying section further has a gripper opener assigned thereto for opening the trailing edge grippers carrying the trailing edges of the sheets in order to decurl the sheets. After the sheets have traversed the decurler and decurling has been carried out, the trailing edges are once more grasped with the trailing edge grippers for renewed positive guidance.

8 Claims, 5 Drawing Sheets

SHEET PROCESSING MACHINE WITH A SHEET DECURLER

BACKGROUND OF THE INVENTION

Field of the Invention

The invention lies in the field of sheet processing and printing technology. More specifically, the invention relates to a sheet processing machine, in particular a rotary printing press, having first grippers which transport the sheets along a conveying section with positive guidance of the leading edges of the sheets, and having second grippers for guiding the trailing edges of the sheets.

A machine of this type is known, for example, from German Patent No. 627851, which deals with a delivery in a gravure press. Due to that background, no problems are to be expected during the formation of a stack in its stack forming station, which originate from the fact that the sheets arrive at the stacking station with a permanent deformation, specifically because, in the gravure printing process, because of the inks used for this purpose, the effect of the printed sheets adhering to the rubber blanket, which is disadvantageous in the offset process, does not occur, the effect leading to the sheets adhering to the rubber blanket by a certain trailing angle, as it is known, after leaving the press nip and then being pulled off the rubber blanket with plastic deformation. This effect occurs in particular if the sheets are printed on one side.

SUMMARY OF THE INVENTION

It is accordingly an object of the invention to provide a sheet processing machine with a sheet decurler which overcomes the above-mentioned disadvantages of the heretofore-known devices and methods of this general type and which develops a corresponding machine such that, even in the event that it is equipped with offset printing units, problems during the formation of a delivery stack because of deformed sheets are counteracted.

With the foregoing and other objects in view there is provided, in accordance with the invention, a sheet processing machine in which sheets with leading edges and with trailing edges travel along a conveying path. The machine comprises:

first grippers disposed to grip the leading edges of the sheets and to slave the sheets along a conveying section with positive guidance of the leading edges;

second grippers disposed to guide the trailing edges of the sheets and configured to be selectively opened;

a sheet decurler operatively associated with the conveying section;

a gripper opener configured to open the second grippers guiding the trailing edges of the sheets when the sheets reach the sheet decurler; and a sheet guide device for aligning the trailing edges of the sheets leaving the sheet decurler for renewed gripping by the second grippers.

The solution provided for this purpose is distinguished by a sheet decurler assigned to the conveying section, a gripper opener which opens the second grippers guiding the trailing edges of the sheets when the sheets reach the sheet decurler, and a sheet guide device which aligns the trailing edges of the sheets leaving the sheet decurler for renewed positive guidance by the second grippers. This makes it possible to use the advantages associated with positive guidance of the sheets at their leading and trailing edges even when printing sheets on one side by the offset process. To this extent, the following explanations are based on a machine in the form of a rotary offset press.

In accordance with an added feature of the invention, the sheet guide device includes:

a sheet guide surface running at a distance from a gripper path defined by the grippers;

nozzles opening into the sheet guide surface for discharging a sheet carrying air stream; and a pressurized air supply system for producing the sheet carrying air stream.

In accordance with an additional feature of the invention, the sheet guide device includes guide surface strips running along a section of a gripper path defined by the first and second grippers, supporting the sheets along the section of the gripper path, and forming clearances for the grippers traveling along a circulating path.

In accordance with another feature of the invention, the guide surface strips form a part of a suction chamber formed with suction openings facing the gripper path and communicating with an interior of the suction chamber, and wherein the suction chamber is fluidically connectible to a vacuum source.

In accordance with a further feature of the invention, the guide surface strips define a course with at least one elevation and at least one depression.

In accordance with a concomitant feature of the invention, a sheet guidance device extends from the sheet decurler away against the conveying direction, i.e., upstream with respect to the conveying direction.

With the above and other objects in view there is also provided, in accordance with the invention, a method of decurling a sheet, which comprises:

prior to decurling a sheet, guiding the sheet with first grippers at a leading edge of the sheet and guiding the sheet with second grippers at the trailing edge of the sheet;

releasing the trailing edge from the second grippers and decurling the sheet;

subsequently aligning the sheet and gripping the trailing edge of the sheet with the second grippers.

It will be understood that the aforementioned grippers are normally closed grippers, as are conventional in the prior art. Such grippers are disclosed, for example, in German published patent application DE 36 05 534 A1.

Other features which are considered as characteristic for the invention are set forth in the appended claims.

Although the invention is illustrated and described herein as embodied in a sheet processing machine with a sheet decurler, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
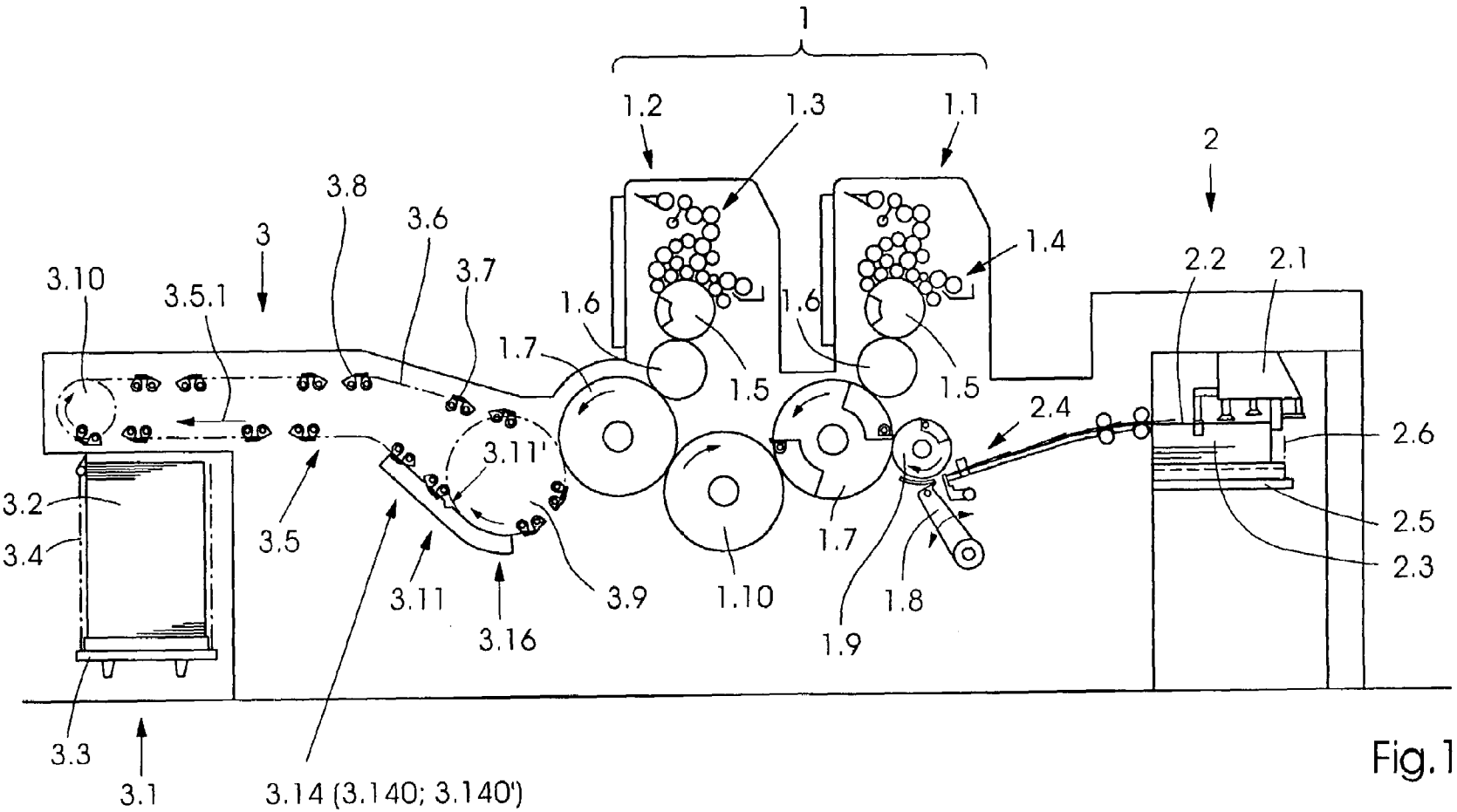
FIG. 1 is a schematic illustration of a rotary printing press processing sheets by the offset process with two printing units, a sheet decurler, and a following sheet guide device for aligning the trailing sheet edges.

Referring now to the figures of the drawing in detail and first, particularly, to FIG. 1 thereof, there is shown a schematic of a sheet processing rotary press, which comprises a machine section 1 with, by way of example, two processing stations in the form of printing units 1.1 and 1.2, so that they can be used to print two colors. For each further color, a further printing unit will be provided. For further process steps, such as varnishing, intermediate drying, perforating and so on, in each case a further processing station will be provided. In the exemplary case illustrated here, the printing units 1.1 and 1.2 operate by the wet offset process and, accordingly, in each case comprises an inking unit 1.3 and a dampening unit 1.4, a plate cylinder 1.5 connected thereto and a blanket cylinder 1.6 rolling on the latter during operation, and also an impression cylinder 1.7 carrying a respective sheet.

In order to load the printing units 1.1 and 1.2 with sheets, a feeder 2 is provided which, by way of a separating device 2.1, picks off a respective topmost sheet 2.2 from a stack 2.3 and transfers it to a transport and alignment device 2.4 which aligns a separated sheet on leading edge stops and on at least one side stop, said sheet in each case leading in the processing direction to form an overlapping formation, after its transport in the direction of said leading edge stops, carried out in particular by way of a suction belt table.

An oscillating pregripper 1.8 assigned to the first processing station, i.e., the printing unit 1.1 here, in each case picks up the respectively aligned sheet 2.2 and transfers the latter to a feed drum 1.9, which in turn transfers it to the impression cylinder 1.7 of the printing unit 1.1. After passing through the press nip of the printing unit 1.1, the impression cylinder 1.7 of the latter transfers the sheet 2.2 to a transfer device connected between the impression cylinders 1.7 of the two printing units 1.1 and 1.2, in the form of a sheet guide drum 1.10. In the case of a machine designed for recto and verso printing, a turner device which can be switched over between recto printing operation and recto and verso printing operation will be provided instead. The impression cylinder 1.7 of the printing unit 1.2 picks up the sheet 2.2 from the sheet guide drum 1.10, guides it through the further press nip and then transfers it to an endless conveyor 3.5 which circulates during operation and belongs to a deliverer 3, which ultimately forms a delivery stack 3.2 from the respective sheets 2.2 in a stack forming station 3.1.

During continuous printing, the production level at the stack in the feeder 2, that is to say the vertical position of the respective topmost sheet 2.2, and the fall height of the released sheets 2.2 in the delivery 3, is maintained by way of appropriate tracking of respective platforms 2.5 and 3.3 carrying the sheet pile 2.3 and the delivery stack 3.2, respectively, by means of respective lifting mechanisms, of which only lifting chains 2.6 and 3.4 carrying the platforms 2.5 and 3.3 are indicated.

The endless conveyor 3.5 is formed with endless chains 3.6 that circulate during operation. The chains 3.6 carry gripper bars fitted with normally-closed grippers. The principle of normally closed grippers with a gripper pad and a gripper finger prestressed against the latter, and suitable gripper openers is disclosed, for example, in the above-mentioned German patent application DE 36 05 534 A1.

The gripper is formed of two gripper groups, so that two groups of gripper bars are also provided. Grippers 3.7 of a first group, called leading edge grippers below, are provided to transport the edges of the sheets 2.2 leading in the conveying direction 3.5.1, and grippers 3.8 of a second group, called trailing edge grippers below, are provided to transport the trailing edges of the sheets 2.2. The leading edge grippers 3.7 pick up the respectively leading edge of the sheets 2.2 in a known way from grippers of the last sheet carrying cylinder of the machine section 1. In order to pick up the trailing edges of the sheets 2.2 by means of the trailing edge grippers 3.8, recourse is made, for example, to the teachings of DE 100 14 417 A1.

The endless chains 3.6 circulating during operation run around drive sprockets 3.9 and deflection sprockets 3.10, the drive sprockets 3.9 being operatively connected to a machine drive, not illustrated here. The leading-edge grippers 3.7 and the trailing edge grippers 3.8, controlled by appropriate gripper openers not illustrated here, pick up a respective sheet 2.2 in the present exemplary embodiment of the machine section 1 from the impression cylinder 1.7 of the printing unit 1.2 and guide its leading and its trailing edges positively along a deflection region, determined by the drive sprockets 3.9, of a conveying section through which the grippers pass, which extends from the impression cylinder 1.7 as far as the region of the stack forming station 3.1 and constitutes a section of a gripper path 3.15 through which the grippers pass overall.

In the example according to FIG. 1, this conveying section is then assigned a sheet decurler 3.11 following its deflection region.

Figure 2:
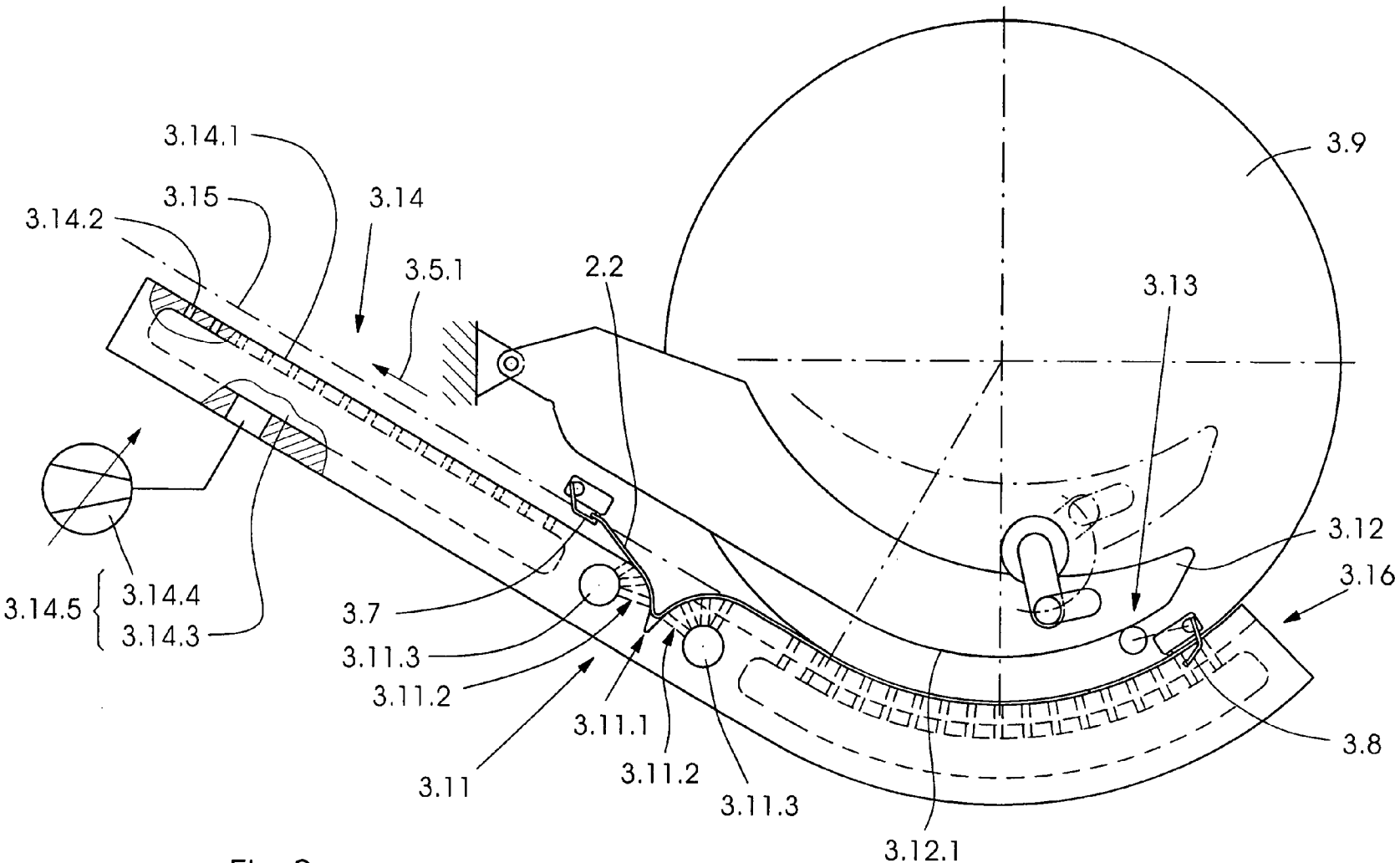
FIG. 2 is a side view of an exemplary embodiment of the sheet decurler, a first configuration of the sheet guide device and a sheet guidance device disposed upstream of the sheet decurler with respect to the sheet transport direction, the sheet decurler following a deflection region of a gripper path through which grippers pass.

In the present exemplary embodiment according to FIG. 2, the sheet decurler 3.11 forms a decurling notch 3.11.1. The notch extends transversely with respect to the conveying direction over a length which is at least equal to the corresponding extent of the sheets 2.2 with the maximum format that can be processed, and it communicates via suction ducts 3.11.2 and suction connections 3.11.3 with a vacuum source, such as a non-illustrated vacuum generator.

In order to decurl the sheets 2.2, as is known, they are drawn over the decurling notch 3.11.1, the vacuum prevailing in the latter causing a corrugation projecting into the decurling notch 3.11.1. In order to permit the formation of this corrugation, the positive guidance of the trailing edges of the sheets 2.2 is cancelled when a respective one of the sheets 2.2 reaches the sheet decurler 3.11. For this purpose, a gripper opener 3.12 provided with a gripper opening cam 3.12.1 is provided and, by way of the opener and a roller lever configuration 3.13, a cam follower is formed, by means of which those trailing edge grippers 3.8 which guide the trailing edge of that one of the sheets 2.2 which reaches the sheet decurler 3.11 are opened. The cam follower otherwise comprises a gripper shaft carrying the gripper fingers of the trailing edge grippers 3.8, which is firmly connected so as to rotate with the roller lever arrangement 3.13 and, as a result of the latter being deflected by the gripper opener 3.12, more precisely by the gripper opening cam 3.12.1 formed on the latter and running equidistantly from the gripper path 3.15, is pivoted with the effect of opening the normally closed trailing edge grippers 3.8.

After a sheet 2.2 has passed the sheet decurler 3.11, positive guidance of the trailing edge of the sheet 2.2 is carried out again, which means that the trailing edge is again gripped by the trailing edge grippers 3.8 which, for this purpose, close again automatically after leaving the gripper opening cam 3.12.1. Renewed gripping is possible only when the trailing edge of the sheet 2.2 is moving on the path which runs between the aforementioned gripper pads and the gripper fingers of the trailing edge grippers 3.8 lifted off said gripper pads. This is implemented by the sheet 2.2 leaving the sheet decurler 3.11 being drawn over a sheet guide device which follows the sheet decurler 3.11 in the direction of the stack forming station 3.1 and which aligns the trailing edge of this sheet 2.2 appropriately in order for it to be gripped by the trailing edge grippers 3.8, that is to say, in particular, forces on the trailing edge of this sheet 2.2 the aforementioned path running between the gripper pads and the gripper fingers lifted off the latter.

The gripper opening cam 3.12.1 and the trailing edge grippers 3.8 are in particular formed in such a way that, at least until the trailing edge of the sheet 2.2 leaving the sheet decurler 3.11 has been aligned in the conveying direction 3.5.1, the ends of the gripper fingers interacting with the gripper pads, in the opened state of the trailing edge gripper 3.8, are located upstream of this edge, so that this edge can assume its aligned position without hindrance.

In FIG. 2, a suitable sheet guide device 3.14 is reproduced in a first configuration of the same. In this case, the sheet guide device 3.14 forms a sheet guide surface 3.14.1, whose extent in the conveying direction is preferably matched to the corresponding extent of the sheets 2.2 with the maximum format that can be processed, and whose physical position is equidistant from the gripper path 3.15. Into the sheet guide surfaces 3.14.1 there open nozzles 3.14.2, which are illustrated only symbolically here and communicate with a blown air chamber 3.14.3 which, for its part, is connected to a positive pressure generator 3.14.4, likewise only illustrated symbolically here. The construction and arrangement of the nozzles 3.14.2 are chosen such that, given a suitable blown air supply by means of a blown air supply system 3.14.5 formed by means of the blown air chamber 3.14.3 and the positive pressure generator 3.14.4, they discharge a sheet carrying air stream which, between the sheet guide surface 3.14.1 and a sheet 2.2 dragged over the latter by the leading edge grippers 3.7, forms an air pad which keeps said sheet floating.

The floating position of the sheet 2.2 with respect to the gripper path 3.15 is adjusted such that said sheet passes over a path running between the aforementioned gripper pads and the gripper fingers of the trailing edge grippers 3.8 lifted off said pads. For this purpose, for example, the flow parameters of the sheet carrying air stream is matched appropriately to the weight per unit area of the sheet 2.2. One possible way of doing this consists in controlling the output of the positive pressure generator 3.14.4, as indicated in FIG. 2 by means of the symbol for the positive pressure generator 3.14.4 provided with an arrow.

Another possible way of adjusting the floating position of the sheet 2.2 in the manner required for the renewed positive guidance of its trailing edge consists in configuring the sheet guide device in a manner departing from FIG. 2 such that the distance of the sheet guide surface 3.4.1 from the group of path 3.15 is adjustable, while maintaining the flow parameters.

The renewed positive guidance of the trailing edge of a sheet 2.2 leaving the sheet decurler 3.11, by gripping its edge in the floating position of the sheet 2.2, is preferably carried out only after this edge is at a certain distance from the sheet decurler 3.11 and has therefore achieved an adequate quiet run. In particular, therefore, the sheet guide device 3.14 extends in the conveying direction 3.5.1 over a length which substantially corresponds to the extent present in the conveying direction 3.5.1 of the sheets 2.2 with the largest format that can be processed by the machine.

In order to prevent uncontrolled movements of an increasingly shortening section of a sheet 2.2 passing the sheet decurler 3.11 and located upstream of the sheet decurler 3.11 with respect to the conveying direction 3.5.1, a sheet guidance device 3.16, which will be discussed in more detail later, is arranged adjacent to and upstream of said sheet decurler 3.11.

Figure 3:
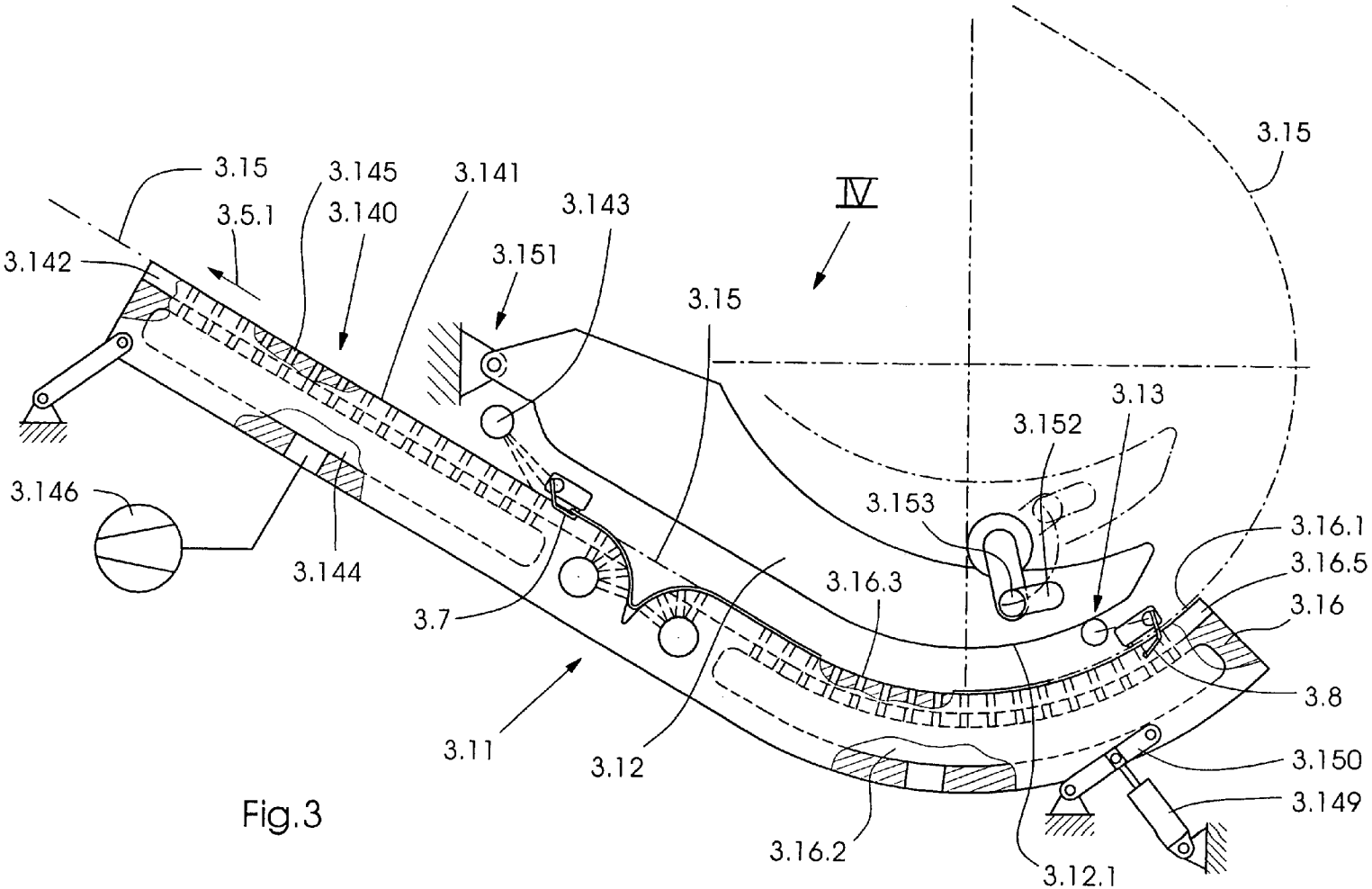
FIG. 3 is a schematic side view of the sheet decurler according to FIG. 2 and a second configuration of the sheet guide device.

The configuration reproduced in FIG. 3 differs from that according to FIG. 2 in that a sheet guide device 3.140 constructed alternatively to the sheet guide device 3.14 is provided. As can be seen in particular in FIG. 4 (a view of the sheet guide device 3.140 in the direction of the arrow IV in FIG. 3), this sheet guide device 3.140 forms guide surface strips 3.141 running along the section of the gripper path 3.15 and supporting the sheets 2.2 along this section. These strips are arranged to follow one another transversely with respect to the conveying direction 3.5.1 at mutual intervals in such a way that, between the guide surface strips 3.141, clearances 3.142 are formed through which the circulating leading edge grippers 3.7 and trailing edge grippers 3.8 can pass. The guide surface strips 3.141 are equidistant from the section of the gripper path 3.15 to which they are assigned, preferably at a distance from the aforementioned gripper pads which, in each case, is in the region of the thickness of the processed sheets 2.2. Upstream with respect to the conveying direction 3.5.1, the guide surface strips 3.141 merge into a downstream edge of the decurling notch 3.11.1. With the sheets 2.2 being supported on the guide surface strips 3.141, the sheets 2.2 are aligned on the guide surface strips 3.141. This alignment is preferably carried out by means of pneumatic assistance.

In a first configuration, pneumatic assistance for the alignment is provided by the sheet 2.2 passing the sheet decurler 3.11 being tautened by pneumatic means with a purely local action.

A first variant of this provides a blowing device 3.143 which, with respect to the conveying direction 3.5.1, is arranged downstream of the sheet decurler 3.11 and outputs a blown air curtain aimed at the sheet 2.2 and pressing the latter against the sheet guide device 3.140 with a directional component preferably pointing counter to the conveying direction 3.5.1. In this case, the blown air curtain acts on a section of the gripper path 3.15 which follows the sheet decurler 3.11 in the conveying direction 3.5.1 and whose extent in the conveying direction 3.5.1 is substantially shorter than that of the sheets 2.2.

For this case of aligning the respectively trailing edge of the sheet 2.2, to this extent a correspondingly short extent of the guide surface strips 3.141 following the sheet decurler 3.11 in the conveying direction 3.5.1 is sufficient.

With regard to the extent of the sheet guide device 3.140 in the conveying direction 3.5.1, the same is also true of a second variant of the alignment of the trailing edges of the sheets 2.2 by tautening the sheets 2.2 by pneumatic means with a purely local action, which can be provided alternatively or additionally and comprise suction openings which are provided on the sheet guide device 3.140 and which, assigned to a correspondingly short section of the gripper path 3.15 following the sheet decurler 3.11 in the conveying direction 3.5.1, are aimed at said gripper path and can be connected to a vacuum generator.

In a second configuration of a pneumatically assisted alignment of the respectively trailing edge of the sheets 2.2 leaving the sheet decurler 3.11, these are supported on the guide surface strips 3.141 and attracted against the latter by suction along the entire extent in the conveying direction 3.5.1. To this end, the sheet guide device 3.140 forms a suction chamber 3.144 that forms the guide surface strips 3.141 and has suction openings 3.145 which face the gripper path 3.15, are connected to the interior of the suction chamber 3.144 and can be fluidically connected to a vacuum generator 3.146. In this case, the extent of the guide surface strips 3.141 in the conveying direction 3.5.1 corresponds at least to that extent which is present in this direction of the sheets 2.2 with the maximum format that can be processed, and the suction openings 3.145 are arranged along the guide surface strips 3.141.

The afore-mentioned clearances 3.142 provided for the passage of the leading edge grippers 3.7 and the trailing edge grippers 3.8 are in this case formed as grooves in a chamber wall of the suction chamber 3.144 which faces the gripper path 3.15 and forms the guide surface strips 3.141.

A development indicated in the further course of the same can advantageously be employed when, on account of specific geometric conditions, the aforementioned gripper pads of the leading edge grippers 3.7 and of the trailing edge grippers 3.8 pass the drive sprockets 3.9 (see FIG. 1) on a radius which is greater than their pitch circle radius. In this case, at the transition of the gripper path 3.15 from its section running along this pitch circle to a straight section, the result is sagging of the sheet 2.2 guided by means of these grippers. Given a course of the guide surface strips 3.141 in one plane, this would result in the situation where the trailing edge of a sheet 2.2, released in order to decurl the same, after passing the sheet decurler 3.11, would be located further upstream with respect to the conveying direction 3.5.1 than the gripper pad and the gripper finger of a trailing edge gripper 3.8 carrying the sheet 2.2 before decurling. In order to counteract this, according to the development indicated, provision is made for guide surface strips 3.141' which have at least one elevation 3.147 and at least one depression 3.148.

Figure 5:
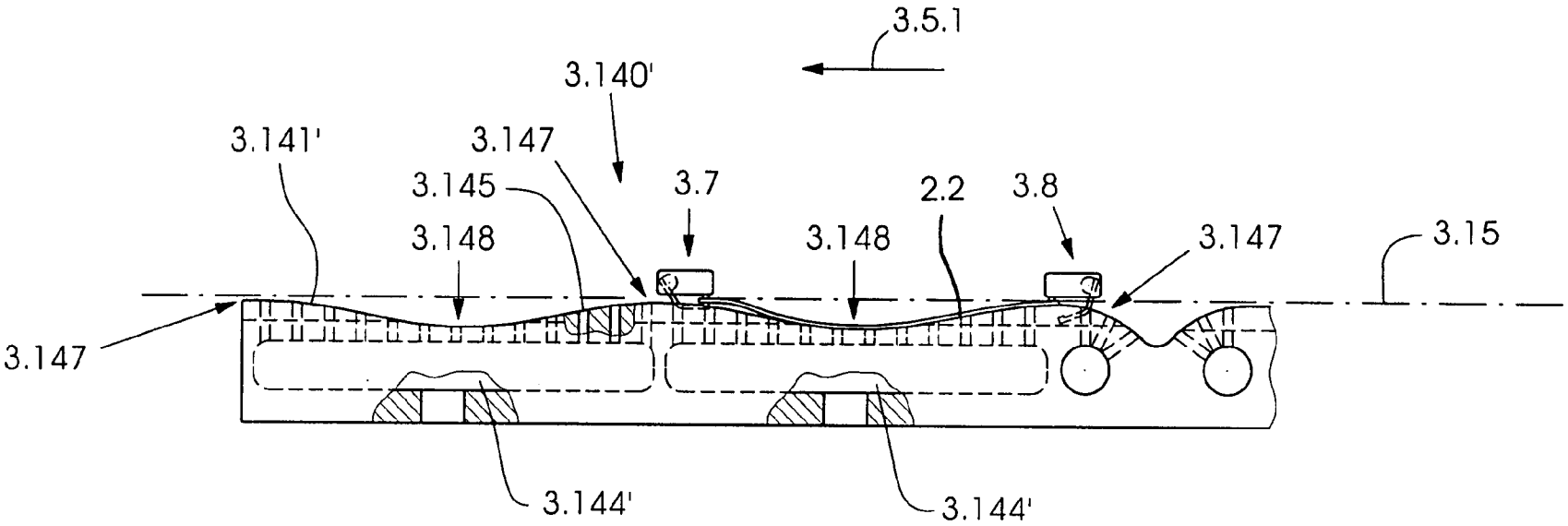
FIG. 5 is a side view of a sheet decurler assigned to a straight section of the gripper path through which grippers pass and a sheet guide device formed in an alternative way to the configuration illustrated in FIG. 4.

In FIG. 5, a sheet guide device 3.140' having such a course of the guide surface strips 3.141' is reproduced qualitatively, specifically using the example of processing sheets 2.2 with a smaller format than the maximum that can be processed. In the case illustrated by way of example, a plurality of elevations 3.147 and depressions 3.148 form a wavy course of the guide surface strips 3.141'.

A respective sheet 2.2 drawn over the sheet guide device 3.14' by the leading edge grippers 3.7 is again laid on the guide surface strips 3.141' by pneumatic assistance. The elevations 3.147 and the depressions 3.148 are dimensioned in such a way that, even for the case of different formats of the sheet 2.2, the trailing edge, released for decurling, of a respective sheet 2.2 laid on the sheet guide device 3.140' assumes substantially the distance from the leading-edge of the same at which it was before the release. To this extent, even in the case of the explained sagging, a possible way is provided for gripping the previously released trailing edge of a respective sheet 2.2 again by means of the trailing edge grippers 3.8 after its decurling for renewed positive guidance by said trailing edge grippers 3.8.

Further requirements are that the trailing edge, during the renewed gripping of the same, is laid on an elevation 3.147 of the guide device 3.140', and in that, in the case of elevations 3.147 which are possibly provided many times and are formed non-uniformly, that one from which the trailing edge is removed is the highest. In this case, the highest elevation 3.147 is to be understood to mean that which is at the shortest distance from the gripper path 3.15 if, as such, the latter is understood to mean the path through which the aforementioned gripper pads pass. This smallest distance is preferably of the order of magnitude of the thickness of the thickest sheets 2.2 processed and is preferably greater than this thickness.

In the present exemplary embodiment, reproduced in FIG. 5, the sheet 2.2 is removed from the first elevation 3.147 following the sheet decurler 3.11. The trailing edge grippers 3.8 provided for this purpose, which are preceded by the leading edge grippers 3.7 at a distance matched to the format of the sheets 2.2, are in this case illustrated in a state shortly before the closure, that is to say in the next instant they will leave the gripper opening cam 3.12.1 (cf. FIGS. 2, 3).

In order to match the afore-mentioned distance of the trailing edge grippers 3.8 from the leading edge grippers 3.7 to the format of the sheets 2.2 that are currently being processed, recourse is made, for example, to the teachings of German patent No. 1 260 482 or our commonly assigned, copending application Ser. No. 10/694,613, which is herewith incorporated by reference.

The dimensioning already indicated of the elevations 3.147 and of the depressions 3.148 also includes the extent of the guidance surface strips 3.141' forming these in the conveying direction 3.5.1. This extent is chosen such that the sheets 2.2 with the largest formats that can be processed by the rotary press can be laid over their entire extent in the conveying direction 3.5.1 on the guide surface strips 3.141'

The likewise already mentioned pneumatic assistance used for this purpose, as already explained in connection with FIG. 3, is carried out by means of an arrangement of suction chambers 3.144' which form the guide surface strips 3.141' and have suction openings 3.145 opening in the direction of the gripper path 3.15. Alternatively or additionally, the respective sheet 2.2 is pressed against the guide surface strips 3.141' by means of blown air.

As indicated in FIG. 1, a rising section of the gripper path 3.15 corresponding substantially to the course of the endless chains 3.6 is assigned to the sheet decurler 3.11, specifically shortly before its transition from a deflection region necessitated by the drive sprockets 3.9 into a straight section of the gripper path 3.15. The representation in FIGS. 2 and 3 corresponds to this case. In this case, the sheet guidance device 3.16 already mentioned at an earlier point and explained in more detail below guides the respective sheet 2.2 released by the trailing edge grippers 3.8 by means of a guide surface 3.16.1, which has an appropriately curved course in the aforementioned deflection region. Starting from the sheet decurler 3.11, this guide surface 3.16.1 extends upstream with respect to the conveying direction 3.5.1 and over a length matched to the largest format of the processed sheets 2.2, that is to say, irrespective of its format, the trailing edge of a respective sheet 2.2 reaches the guide surface 3.16.1 at the latest when it is released by the trailing edge grippers 3.8, that is to say when the leading edge of the respective sheets 2.2 has arrived in the immediate vicinity of the sheet decurler 3.11.

Figure 4:
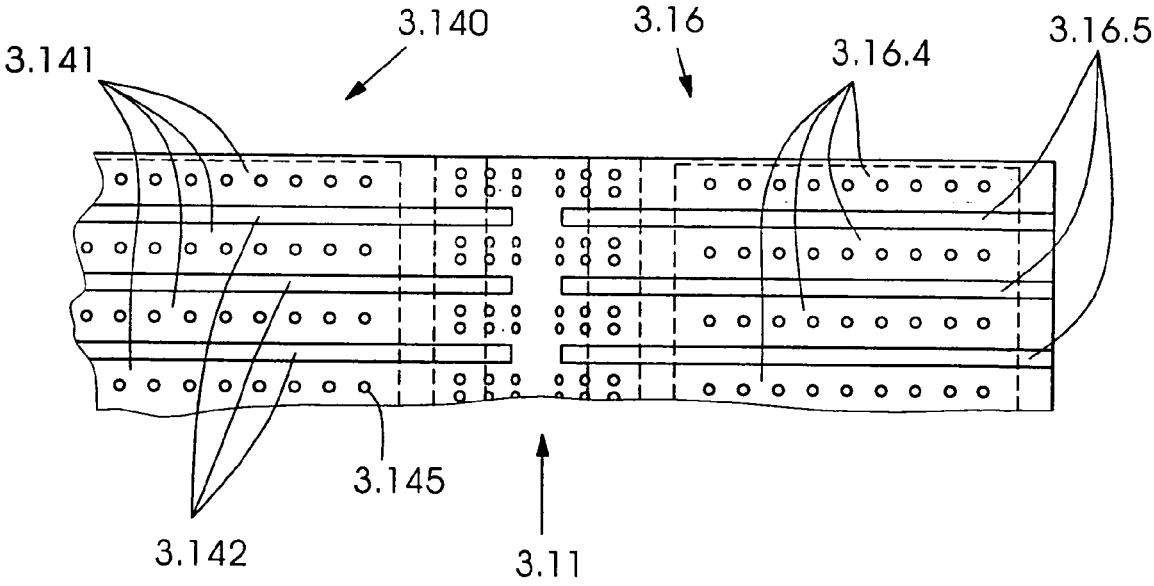
FIG. 4 is a section of a structural unit formed from the sheet decurler, the sheet guide device, and the sheet guidance device, viewed in the direction of the arrow IV in FIG. 3 and in a development in the plane of the drawing.

The sheet guidance device 3.16 in the present exemplary embodiment, apart from the fact that it has a curved guide surface 3.16.1, is constructed in a manner analogous to the sheet guide device 3.140 according to FIGS. 3 and 4 and already explained, and the guidance surface 3.16.1 forming guidance surface strips 3.16.4 analogous to the guide surface strips 3.141 and clearances 3.16.5 lying between them for the passing grippers 3.7 and 3.8 is arranged equidistantly from the gripper path 3.15, in a manner analogous to the guide surface strips 3.141 of the sheet guide device 3.140.

A respective sheet 2.2 is guided by means of the leading edge grippers 3.7 and initially also by means of the trailing edge grippers 3.8 in the processing direction 3.5.1 over the guidance surface 3.16.1, specifically again with pneumatic assistance, which is again carried out here, by way of example, by sucking the sheets 2.2 against the guidance surface 3.16.1.

For this purpose, as can be seen from FIGS. 3 and 4, the sheet guidance device 3.16 is again constructed in the form of a suction chamber 3.16.2 with suction openings 3.16.3 aimed at the gripper path 3.15, and connected to a vacuum generator, not illustrated here. A chamber wall of the suction chamber 3.16.2 facing the gripper path 3.15 forms the aforementioned guidance surface strips 3.16.4 and, again in the form of grooves in this chamber wall, the clearances 3.16.5 for the passage of the leading-edge grippers 3.7 and the trailing edge grippers 3.8. The vacuum prevailing in the suction openings 3.16.3 in the case of such pneumatic assistance for the sheet guidance over the guidance surface 3.16.1 is kept so low that the formation of the corrugation necessary for decurling and mentioned at an earlier point is not impaired.

In order to implement the explained release of a respectively trailing edge of the sheets 2.2 at a time at which the leading edge reaches the sheet decurler 3.11, and for the renewed positive guidance of this edge after the decurling operation has been carried out, the gripper opening cam 3.12.1 already mentioned extends by a first length downstream and by a second length upstream of the sheet decurler 3.11, as can be seen in FIGS. 2 and 3. In this case, the first length is designed such that the trailing edge grippers 3.8 held open by means of the gripper opening cam 3.12.1 close at the point already mentioned, at which the renewed positive guidance of the respectively trailing edge of the sheets 2.2 begins, while the second length corresponds to the extent in the processing direction of one of the sheets 2.2 with the largest possible format that can be processed by the rotary press. The trailing edges of sheets 2.2 with a smaller format are thus already released when the leading edges of these sheets 2.2 have not yet reached the sheet decurler 3.11. However, this has no influence on the decurling process.

The gripper opening cam 3.12.1 and the aforementioned roller lever arrangement 3.13 are otherwise located in an active range such that analogous roller lever arrangements (not illustrated here) assigned to the leading edge grippers 3.7 are not actuated by the gripper opening cam 3.12.1 assigned to the trailing edge grippers 3.8.

For the case mentioned at the outset of the configuration of the rotary press that can be changed over from recto printing to recto and verso printing and vice versa, the gripper opener 3.12 and therefore its gripper opening cam 3.12.1 running equidistantly from the gripper path 3.15 can be adjusted, pivoted in the present case, from an operating position actuating the roller lever arrangement 3.13 into a non-actuating position, and the structural unit comprising the sheet decurler 3.11, the sheet guide device 3.14 or 3.140 or 3.140' and the sheet guidance device 3.16 is arranged such that it can be pivoted away from the gripper path 3.15 from its operating position illustrated in FIGS. 1, 2 and 3. In the exemplary embodiment illustrated, for this purpose, the aforementioned structural unit is attached to links 3.150 which are mounted in a fixed location and can be pivoted by means of an actuating drive 3.149, while the gripper opener 3.12 is attached to a fixed-location pivoting mounting 3.151 and can be pivoted with respect to the pivoting mounting 3.151 by means of a crank pin 3.153 which engages in a slotted guide 3.152 in the gripper opener 3.12 and can be actuated by means not specifically illustrated.

In alternative configurations, a guidance surface formed on the sheet guidance device 3.16 is arranged at such a distance from the gripper path 3.15, or trailing edge grippers are provided that open to such an extent, that it is possible for the formation of the clearances 3.16.5 to be dispensed with.

The machine described to this extent permits a method of decurling sheets according to which the sheets, before being decurled, are guided at a respectively leading edge of the sheets 2.2 by means of first grippers, the leading edge grippers 3.7, and at a respectively trailing edge of the sheets 2.2 by means of second grippers, the trailing edge grippers 3.8, the respective trailing edge is released in order to decurl the sheet 2.2, is aligned after decurling has been carried out and is subsequently gripped again by the second grippers (trailing edge grippers 3.8).

This application claims the benefit, under 35 U.S.C. § 119, of German patent application 103 13 718.1 of Mar. 27, 2003, the entire disclosure of which is herewith incorporated by reference.

We claim:

1. A sheet processing machine in which sheets with leading edges and with trailing edges travel along a conveying path, comprising:

first grippers disposed to grip the leading edges of the sheets and to slave the sheets along a conveying section with positive guidance of the leading edges;

second grippers disposed to guide the trailing edges of the sheets and configured to be selectively opened;

a sheet decurler operatively associated with the conveying section;

a gripper opener configured to open said second grippers guiding the trailing edges of the sheets when the sheets reach said sheet decurler; and a sheet guide device for aligning the trailing edges of the sheets leaving said sheet decurler for renewed gripping by said second grippers.

2. The machine according to claim 1, wherein said sheet guide device includes:

a sheet guide surface running at a distance from a gripper path defined by said grippers;

nozzles opening into said sheet guide surface for discharging a sheet carrying air stream; and a pressurized air supply system for producing the sheet carrying air stream.

3. The machine according to claim 1, wherein said sheet guide device includes guide surface strips running along a section of a gripper path defined by said first and second grippers, supporting the sheets along the section of the gripper path, and forming clearances for said grippers traveling along a circulating path.

4. The machine according to claim 3, wherein said guide surface strips form a part of a suction chamber formed with suction openings facing the gripper path and communicating with an interior of said suction chamber, and wherein said suction chamber is fluidically connectible to a vacuum source.

5. The machine according to claim 3, wherein said guide surface strips define a course with at least one elevation and at least one depression.

6. The machine according to claim 1, which further comprises a sheet guidance device extending from said sheet decurler upstream with respect to the conveying direction.

7. In a sheet-processing machine in which sheets with leading edges and trailing edges are transported along a conveying direction, a method of decurling a sheet, which comprises:

prior to decurling a sheet, guiding the sheet with first grippers at a leading edge of the sheet and guiding the sheet with second grippers at the trailing edge of the sheet;

releasing the trailing edge from the second grippers and decurling the sheet;

subsequently aligning the sheet and gripping the trailing edge of the sheet with the second grippers.

8. A method of decurling a sheet, which comprises:

transporting the sheet through the sheet-processing machine according to claim 1, and thereby holding the leading edge of the sheet with the first grippers and holding the trailing edge of the sheet with the second grippers;

temporarily releasing the trailing edge from the second grippers and decurling the sheet with the sheet decurler; and subsequently gripping the trailing edge of the sheet with the second grippers.

* * * * *